United States Patent [19]

Owens et al.

[11] Patent Number: 4,836,291

[45] Date of Patent: Jun. 6, 1989

[54] PORTABLE SPRINKLER AND PROCESS FOR FIGHTING FIRES IN OIL REFINERIES AND THE LIKE

[75] Inventors: David W. Owens; Jack E. Propp, both of Casper, Wyo.

[73] Assignee: Amoco Corporation, Chicago, Ill.

[21] Appl. No.: 53,139

[22] Filed: May 21, 1987

[51] Int. Cl.[4] ..... A62C 1/02

[52] U.S. Cl. ..... 169/46; 169/48; 169/70; 239/275; 239/598

[58] Field of Search ..... 169/43, 45, 46, 47, 169/48, 49, 50, 54, 70, 51, 52; 239/275, 276, 279, 280, 567, 566, 597, 598, 273

[56] References Cited

U.S. PATENT DOCUMENTS

| | | | |
|---|---|---|---|
| 2,814,529 | 11/1957 | Arnt | 239/566 |
| 2,848,012 | 8/1958 | Scott et al. | 239/280 X |
| 2,903,190 | 9/1959 | Le Deit | 239/276 |
| 3,033,470 | 5/1962 | Choitz | 239/597 X |
| 3,045,931 | 7/1962 | Hall | 239/598 |
| 3,047,238 | 7/1962 | Sacco | 239/275 |
| 3,047,241 | 7/1962 | McLhinney | 239/567 |
| 3,069,100 | 12/1962 | Schuler | 169/48 X |
| 3,241,772 | 3/1966 | Thompson | 239/275 |

*Primary Examiner*—Sherman D. Basinger
*Assistant Examiner*—Paul E. Salmon
*Attorney, Agent, or Firm*—Thomas W. Tolpin; William H. Magidson; Ralph C. Medhurst

[57] ABSTRACT

A special self-erecting portable sprinkler is provided to effectively and efficiently fight fires in oil refineries, petrochemical plants, and the like from a remote safe position.

7 Claims, 8 Drawing Sheets

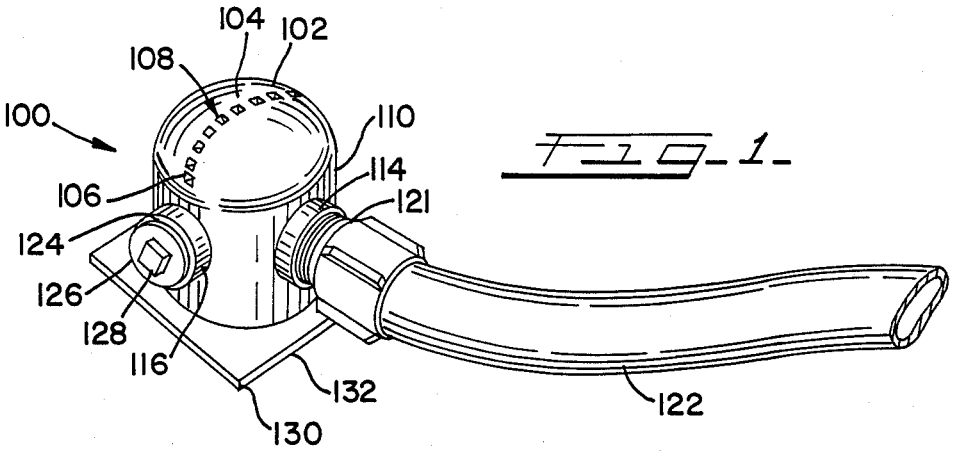
FIG. 1
FIG. 2
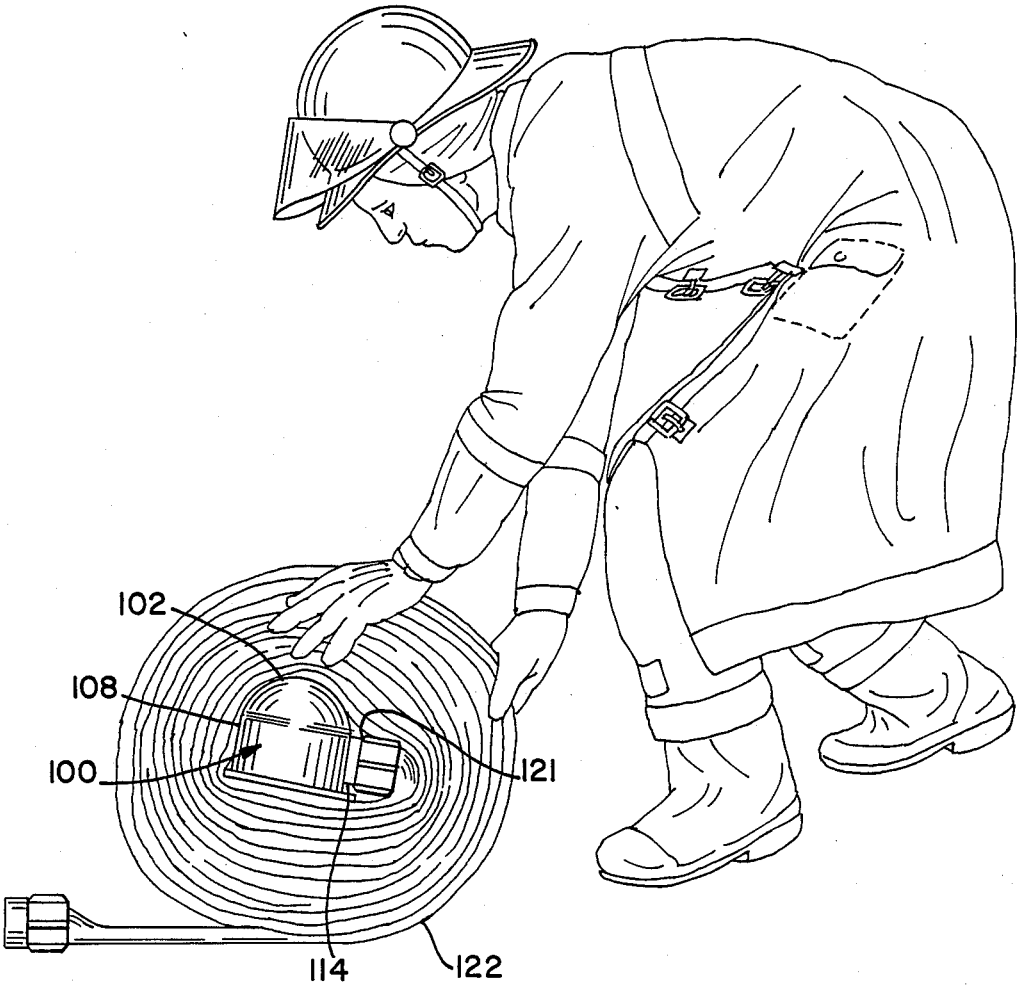

PORTABLE SPRINKLER AND PROCESS FOR FIGHTING FIRES IN OIL REFINERIES AND THE LIKE

BACKGROUND OF THE INVENTION

This invention relates to firefighting equipment and, more particularly, to a portable sprinkler and process for fighting oil refinery fires and the like.

Fires in oil refineries and petrochemical plants are different in many respects than fires in homes, apartments, and office buildings. Fires in homes, apartments, and office buildings occur primarily in the inside of the buildings, although the flames can rise above the buildings' exteriors. Fires in homes, apartments, and office buildings present a different set of problems than fires in oil refineries and petrochemical plants.

Fires in oil refinreies and petrochemical plants occur primarily on the outside and in the open air where there are gusts of wind and an endless supply of air to support combustion. Fires in oil refineries and petrochemical plants often involve or are near large amounts of fuel and process equipment which can feed the fire and/or cause enormous explosions. These sources of combustible fuel can include aboveground tanks containing gasoline, oil, petrochemical feedstocks, and other hydrocarbons, as well as numerous oil pipelines and gas lines. Refinery process equipment typically includes hydrotreaters which contain hydrogen-rich gases at high pressures and temperatures, catalytic cracking units, pipe stills, fractionating columns, combustors, regenerators, furnaces, CO boilers, alkylation units, and/or isomerization units.

Fires in oil refineries and petrochemical plants are extremely dangerous. They can cause extensive damage to a refinery or petrochemical plant as well as to property in adjacent areas. Such fires and explosions can also cause death and severe injuries to personnel in the refinery or petrochemical plant and nearby persons.

Fires in oil refineries and petrochemical plants often emit enormous flames, fireballs, billows of smoke, immense heat, and clouds of noxious toxic gases. Because of the vast amounts of heat generated by the fire, it is often difficult, if not impossible, to get firefighting crews with hoses, sprinklers, or other equipment close enough to the fire to quickly, efficiently and effectively contain and extinguish the fire. Furthermore, smoke and toxic gases emitted from petroleum fires often also prevent firefighting personnel from getting sufficiently near the fire with their hoses, sprinklers, and other equipment to quickly and effieiently, abate the fire.

Over the years, a variety of sprinklers, spray nozzles, water fans, and other devices have been used for fighting fires and for other purposes. Typifying these prior art sprinklers, spray nozzles, water fans, and other devices are those shown in U.S. Pat. Nos. 600,149; 941,109; 2,516,401; 2,903,190; 2,956,751; 3,045,931; 3,047,238; 3,047,241; 3,069,100; 3,109,593; 3,241,772; and 3,252,661. These prior art sprinklers, spray nozzles, water fans, and other devices have met with varying degrees of success and have not been generally effective for containing and extinguishing fires in oil refineries and petrochemical plants.

It is, therefore, desirable to provide an improved system and process for fighting fires in oil refineries and petrochemical plants whichever overcomes most, if not all, of the preceding problems.

SUMMARY OF THE INVENTION

An important portable sprinkler and process is provided for fighting fires in oil refineries, petrochemical plants, and the like.

Advantageously, the novel portable sprinkler in the process is efficient, easy to use, and effective. The improved portable sprinkler and process can help quickly contain and extinguish fires in refineries and petrochemical plants while protecting firefighting personnel by setting up a spray mist and wall or curtain of water on the fire as well as between the fire and firefighting personnel. The novel equipment and process helps keep the fire from spreading by cooling the temperatures in the area surrounding the fire and minimizes injuries to personnel by dissipating the toxic gases and smoke.

In the novel firefighting process a unique self-righting sprinkler is remotely placed in an upright erect position near the fire while firefighting personnel stay safely away from the fire. This can be accomplished by attaching one end of the sprinkler to a firefighting hose and coiling the sprinkler in the hose. The other end of the hose can be attached to a fire hydrant, fire truck, or other water supply. The coiled hose containing the sprinkler can then be rolled or flung in a direction towards the fire. The water is then turned on by opening a valve on the fire hydrant or other water supply. This will cause the hose to uncoil and expand somewhat like a party favor while moving the sprinkler to an upright erect position and simultaneously activating the sprinkler to spray a mist, curtain, and wall of water between the fire and firefighting personnel.

The unique portable sprinkler can have a round spray head with a water reservoir chamber perferably surrounded by a rounded tubular neck, at least one port for connecting a firefighting hose to the water reservoir chamber, and a weighted base. The base preferably has a flat or planar bottom. The sprinkler has a low center of gravity near the base so that movement of the sprinkler will abate and stabilize when the sprinkler moves to an upright erect position upon the weighted base. The spray head and the tubular neck are rounded to help pivot the spray head and neck off the ground to an upright erect position with the bottom of the base seated upon the ground, as a result and in cooperation with the water pressure in the sprinkler and water spray emitted from the sprinkler.

The rounded spray head of the sprinkler has one or more fluid flow passageways to spray and inject a mist or stream of water upon the fire and between the fire and firefighting personnel. Preferably, the fluid flow passageway comprises an arcuate set of apertures, slots, or holes which extend for at least 90 degrees and preferably greater than 130 degrees along the top of the spray head. Should the spray head or neck rest upon or be positioned adjacent to the ground, the arrangement of flow passgeways will cause the high pressure water spray being ejected from the spray head to push against the ground and cause the spray head to pivot, tip, and move in an opposite direction to an upright erect position above the ground.

In one embodiment, the spray head and neck are positioned in a vertical alignment to maximize the height of the water spray and curtain of water. In another embodiment, the spray and neck are positioned at an angle of inclination to direct the spray mist and curtain of water closer towards the fire or other areas.

A more detailed explanation is provided in the following description and appended claims taken in conjunction with the accompanying drawings.

BRIEF DESCRIPTION OF THE DRAWINGS

FIG. 1 is a perspective view of a sprinkler attached to a hose in accordance with principles of the present invention;

FIG. 2 is a perspective view of the sprinkler being coiled in a hose;

DETAILED DESCRIPTION OF THE PREFERRED EMBODIMENT

Figure 3:
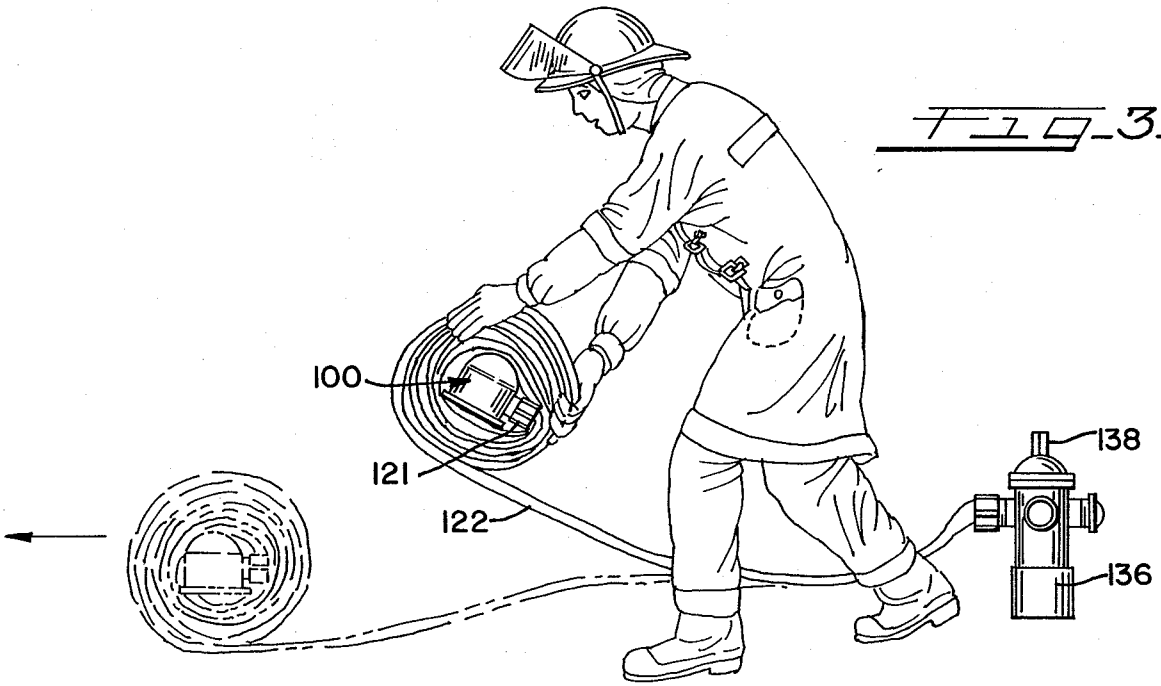
FIG. 3 illustrates in solid line the coiled hose and sprinkler being flung by a person towards a fire and in dotted line the coil hose and sprinkler uncoiling in a direction towards the fire.
Figure 4:
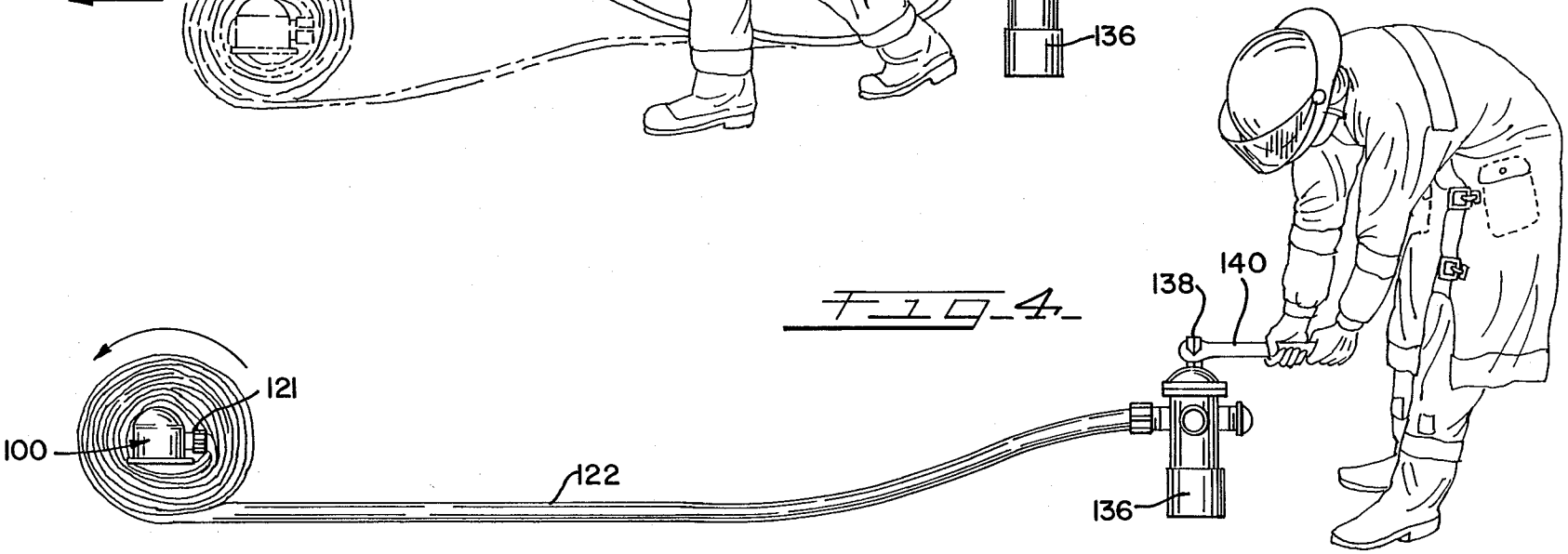
FIG. 4 illustrates the valve of the fire hydrant being opened.

The portable self-erecting sprinkler 100 of FIGS. 1–9, which is also referred to as a portable self-standing water fan, spraying device, and water curtain nozzle, is particularly useful for fighting fires in oil refineries, petrochemical plants, and other outside facilities. The sprinkler is fabricated of metal, such as corrosion resistant steel or iron alloy coated with heat resistant paint.

The sprinkler 100 has a hemispherical, rounded, curved spray head 102 (FIG. 1). The spray head 102 provides the top of the sprinkler and has a rounded apex 104. The rounded spray head 102 facilitates pivoting and rotation of the sprinkler to an upright erect position. The spray head 102 has an arcuate set of coplanar rectangular holes or apertures 106 to inject a spray or mist of water in an arcuate spray pattern. The spray holes 106 of the sprinkler of FIGS. 1–9 lie in a common vertical plane and collectively provide a fluid flow passageway 108 which preferably extend from at least about 90 degrees to about 200 degrees.

Figure 5:
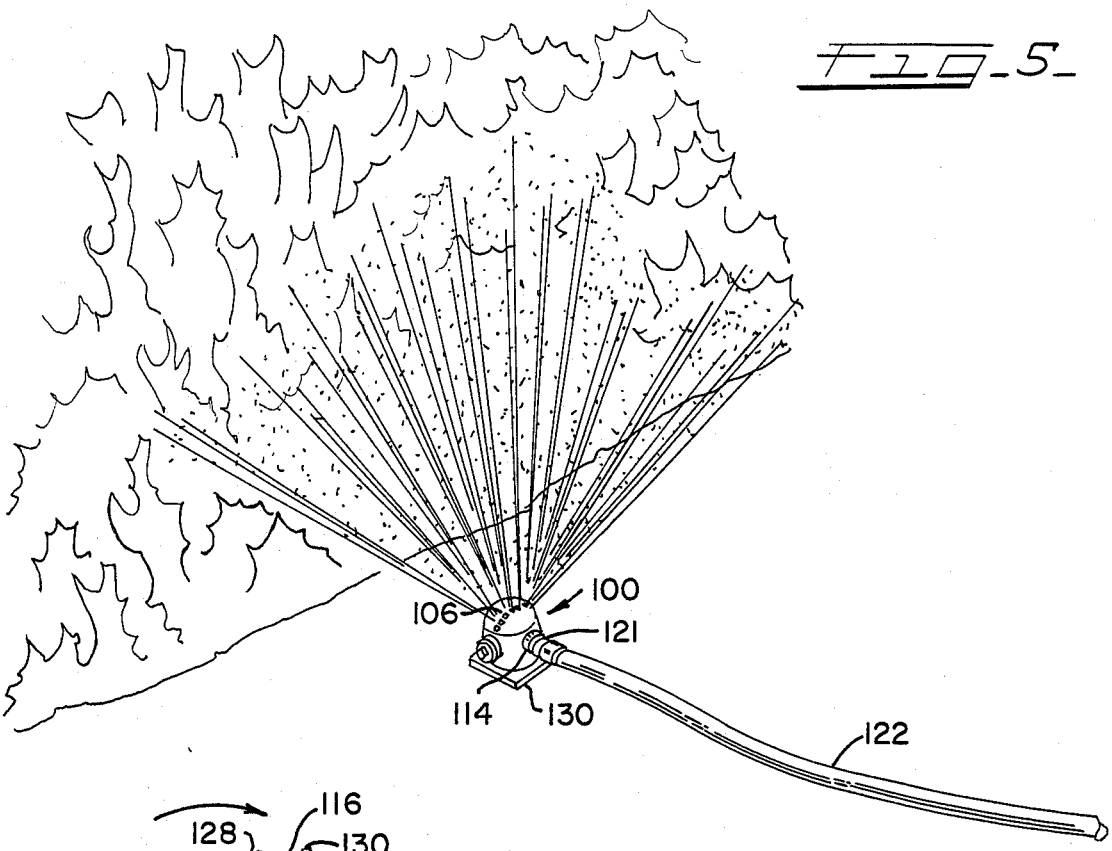
FIG. 5 is a reduced perspective view of the sprinkler spraying a mist, curtain, and wall of water.
Figure 6:
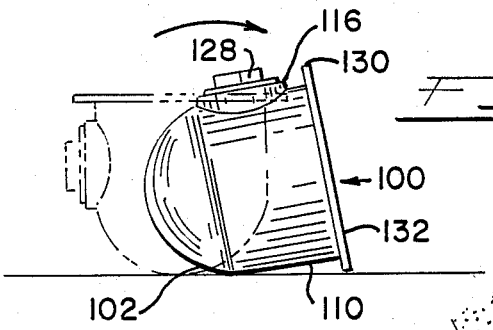
FIG. 6 is a perspective view of the sprinkler being pivoted from an upside position, shown in dotted lines, to a side position, shown in solid line before being pivoted to an upright erect position.
Figure 7:
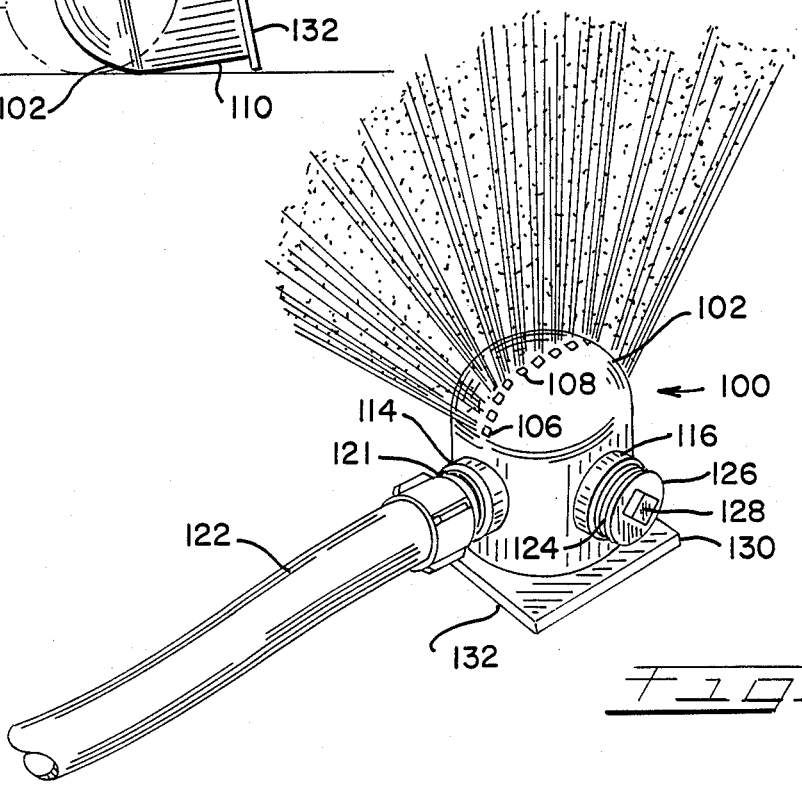
FIG. 7 is a perspective view of the sprinkler in an upright erect position.
Figure 8:
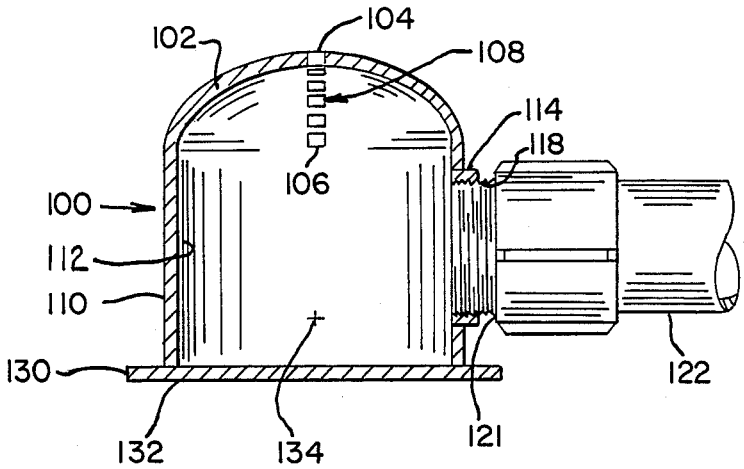
FIG. 8 is a cross-section left side view of the sprinkler.
Figure 9:
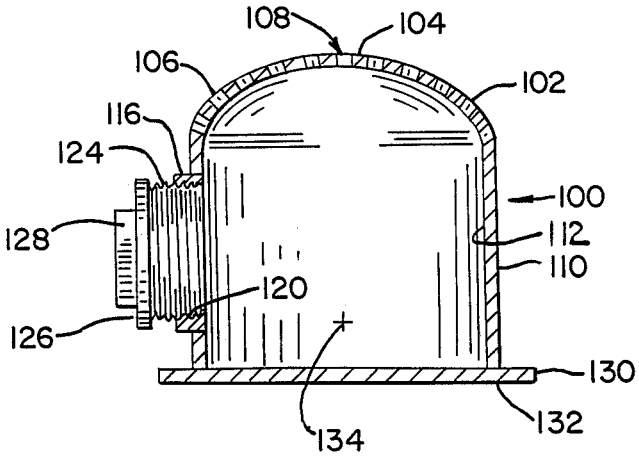
FIG. 9 is a cross-section front view of the sprinkler.
Figure 10:
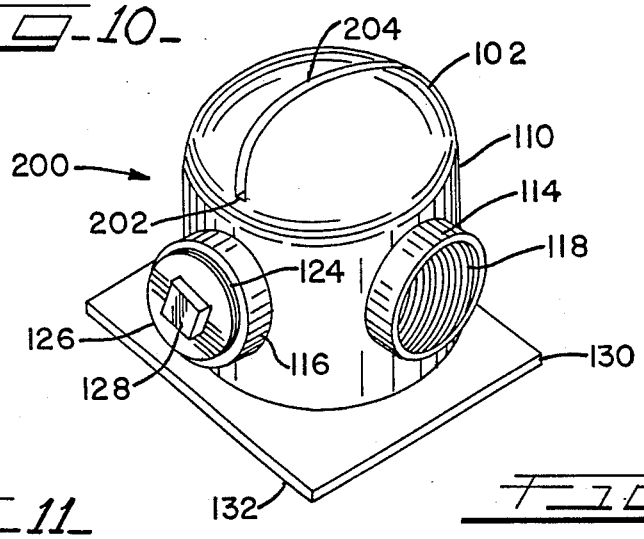
FIG. 10 is a perspective view of a sprinkler similar to FIG. 1 but with a spray head with an arcuate slot rather than an arcuate set of rectangular apertures.
Figure 11:
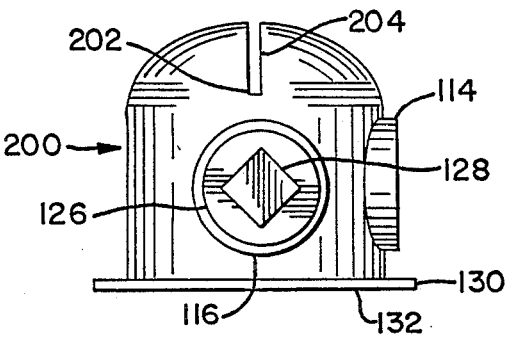
FIG. 11 is a left side view of the sprinkler of FIG. 10.
Figure 12:
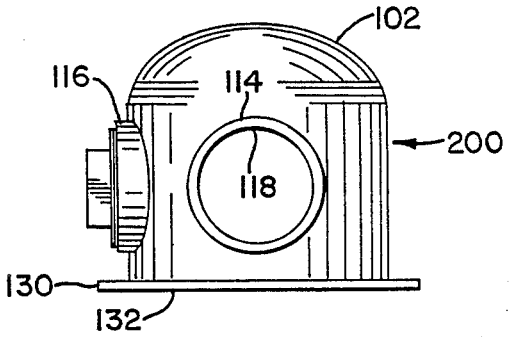
FIG. 12 is a front view of the sprinkler of FIG. 10.
Figure 13:
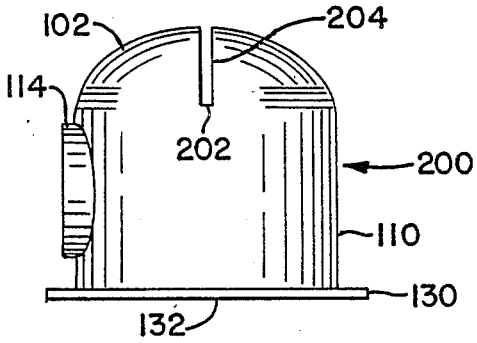
FIG. 13 is a right side view of the sprinkler of FIG. 10.
Figure 14:
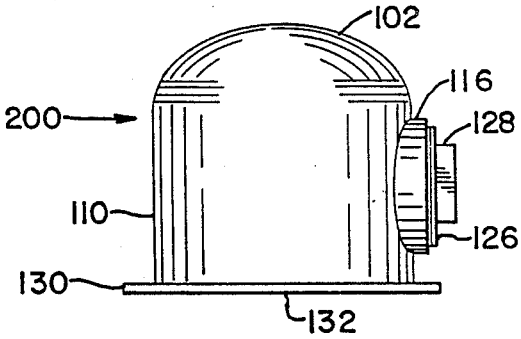
FIG. 14 is a back view of the sprinkler of FIG. 10.
Figure 15:
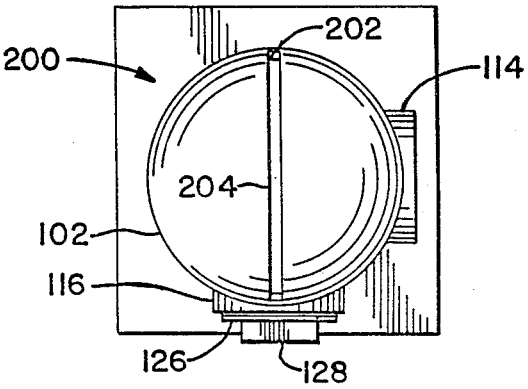
FIG. 15 is a top view of the sprinkler of FIG. 10.
Figure 16:
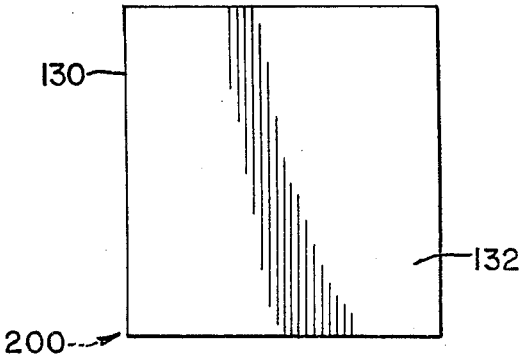
FIG. 16 is a bottom view of the sprinkler of FIG. 10.
Figure 17:
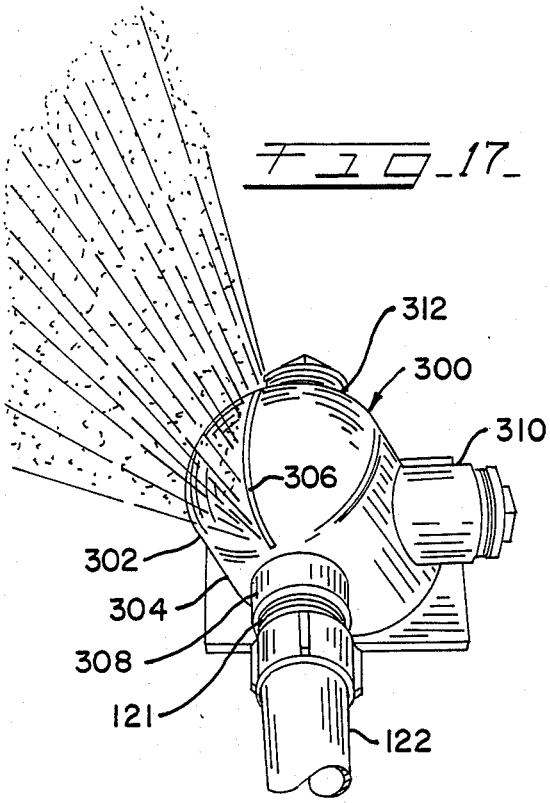
FIG. 17 is a left side perspective view of another sprinkler in accordance with principles of the present invention with the hose attached to the left port.
Figure 18:
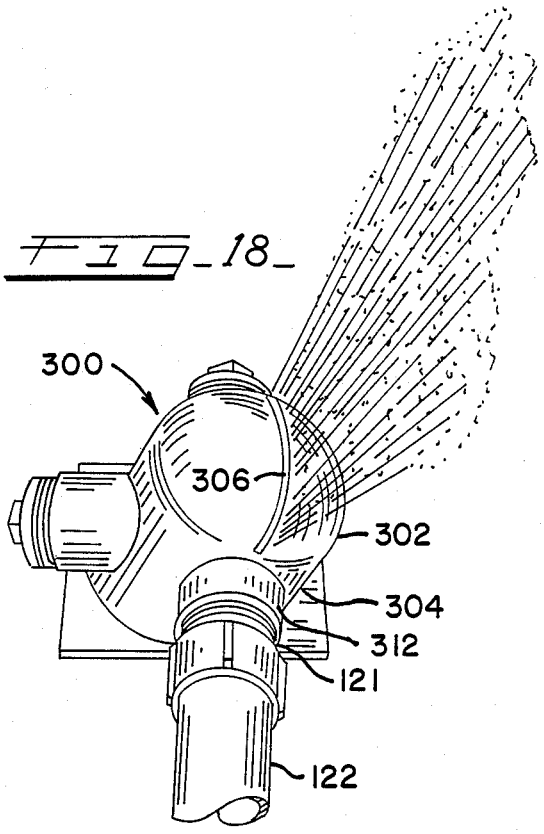
FIG. 18 is a right side perspective view of the sprinkler of FIG. 17 with the hose attached to the right port.
Figure 19:
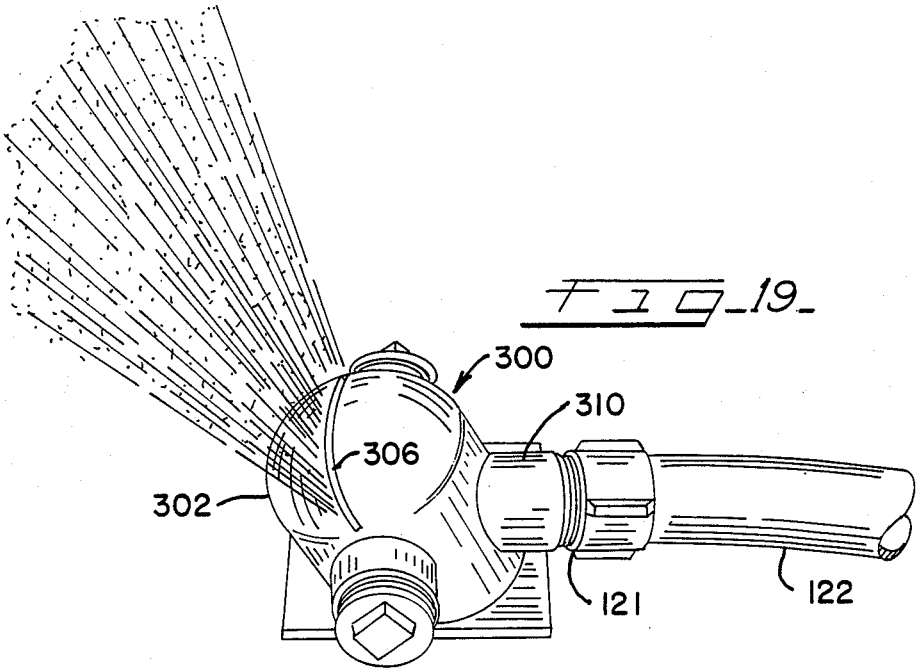
FIG. 19 is a view similar to FIG. 17 but with the hose attached to the front port.
Figure 20:
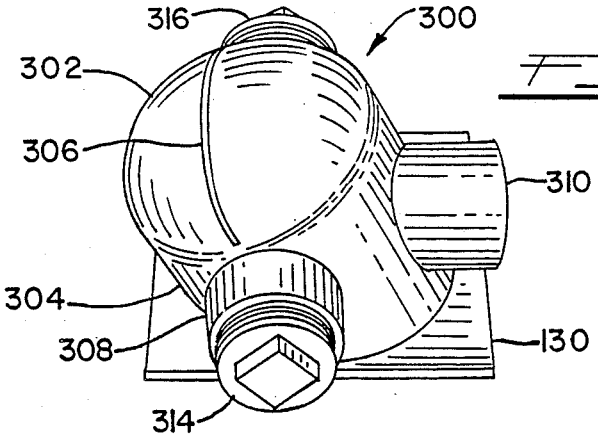
FIG. 20 is a left side perspective view of the sprinkler of FIG. 17.
Figure 21:
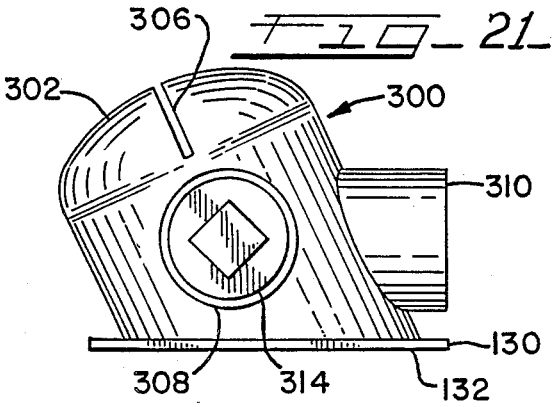
FIG. 21 is a left side view of the sprinkler of FIG. 17.
Figure 22:
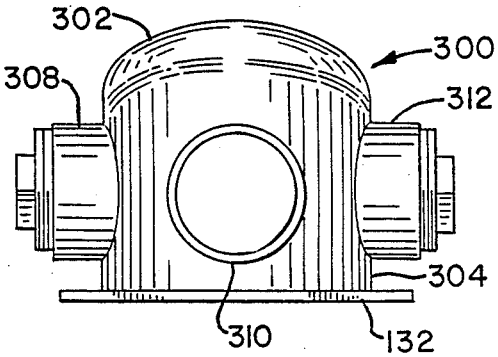
FIG. 22 is a front side view of the sprinkler of FIG. 17.
Figure 23:
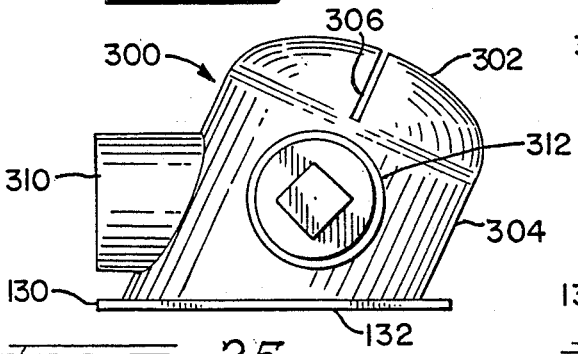
FIG. 23 is a right side view of the sprinkler of FIG. 17.
Figure 24:
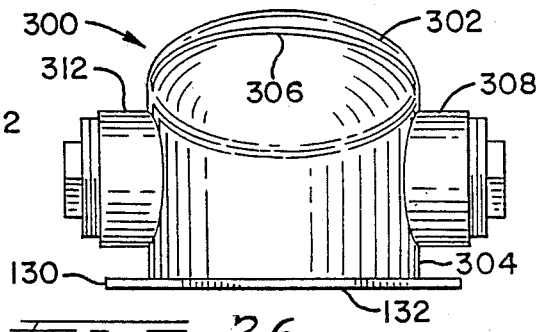
FIG. 24 is a back view of the sprinkler of FIG. 17.
Figure 25:
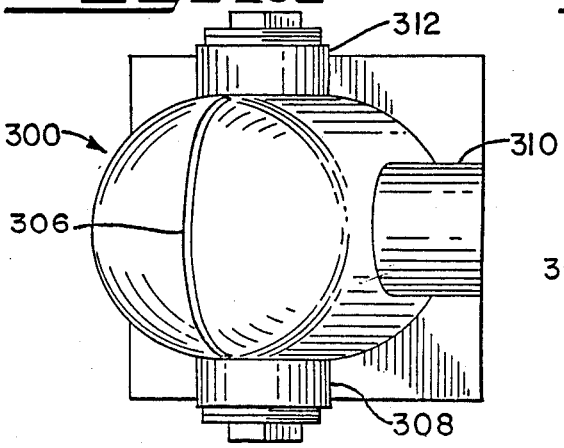
FIG. 25 is a top view of the sprinkler of FIG. 17.
Figure 26:
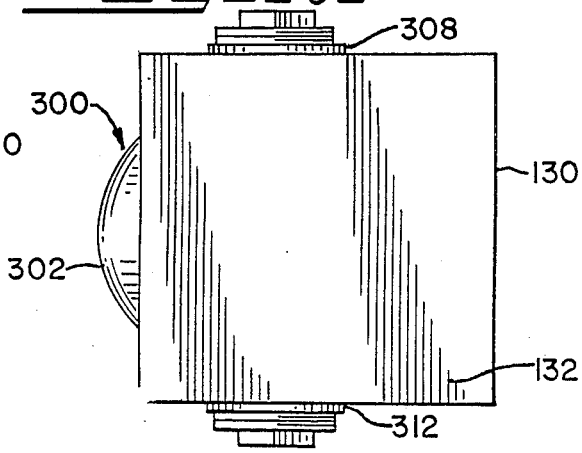
FIG. 26 is a bottom view of the sprinkler of FIG. 17.
Figure 27:
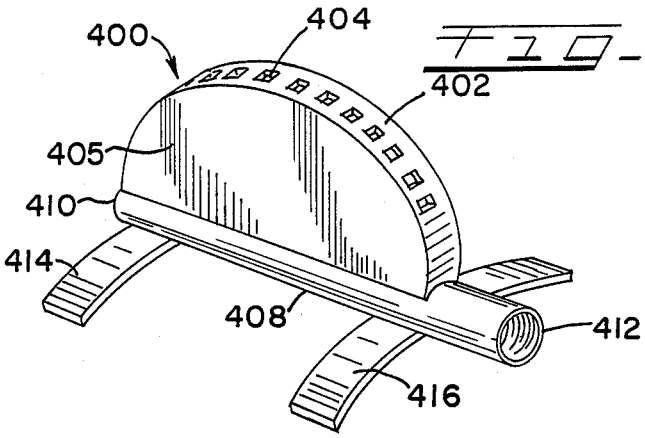
FIG. 27 is a perspecive view of an arcuate dinosaur-shaped sprinkler with flat sides and curved feed in accordance with principles of the present invention.
Figure 28:
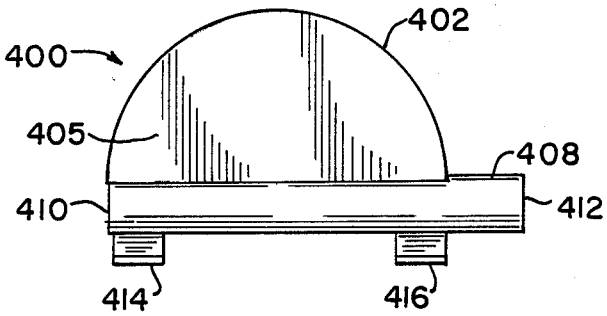
FIG. 28 is a left side view of the sprinkler of FIG.27.
Figure 29:
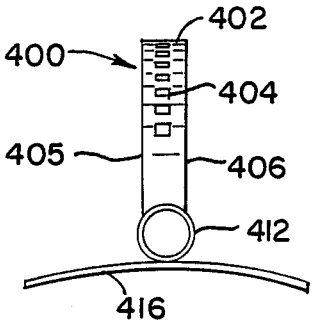
FIG. 29 is a front view of the sprinkler of FIG. 27.
Figure 30:
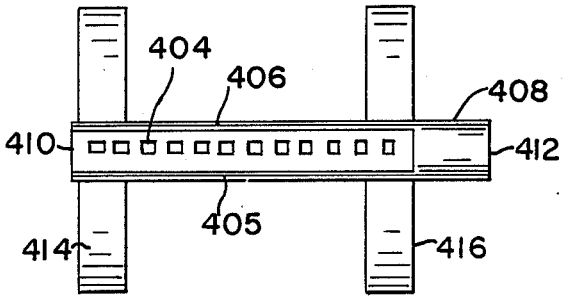
FIG. 30 is a top view of the sprinkler of FIG. 27.
Figure 31:
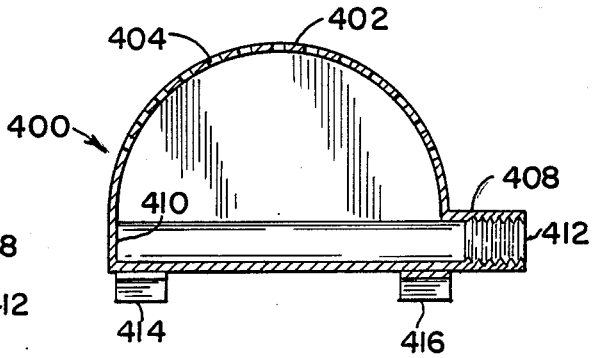
FIG. 31 is a cross-sectional left side view of the sprinkler of FIG. 27.

The sprinkler 100 (FIG. 100) has a rounded neck 110 with a circular cross section. The rounded neck 110 facilitates pivoting of the sprinkler towards an upright erect position. The neck 110 annularly surrounds and encloses an interior water reservoir chamber and compartment 112 (FIGS. 8 and 9) which communicate with a lateral, horizontal, tubular front arm 114 and left side arm 116. Each of the arms 114 and 116 extends horizonatally outwardly from the neck 110 and provides a port. Each arm 114 and 116 has internal threads 118 or 120 to threadedly receive the externally threaded coupling 121 of a firehose 122 or an externally threaded portion 124 of a circular plug 129. The plug 126 can have a hexagonal or square nose 128 on its external face to facilitate insertion and removal of the plug with a wrench. The arms 114 and 116 are positioned perpendicular to each other to permit the hose to be attached to either arm. When the hose is attached to the front arm 114, the spray hole 106 and water spray pattern are at right angles (perpendicular) to the coupling 121 and end of the hose 122 as shown in FIG. 5. When the hose is attached to the side arm 116 of the sprinkler, the spray holes 106 and water spray pattern are positioned parallel and in alignment with the coupling 121 and end of the hose 122 as shown in FIG. 7. The plug 126 should be connected to the arm not engaging the hose to the plug and block outward flow of water through that arm.

The sprinkler 100 (FIG. 1) has a weighted (heavy) horizontal, rectangular base 130 which is welded or otherwise connected to the bottom of the neck 110. The base 130 is preferably square and in coaxial alignment with and positioned symmetrically about the neck 110. The base 130 extends outwardly from the neck to increase the stability and bias of the sprinkler to an upright position. The base 130 has an imperforate bottom surface 132 which provides a solid water-impervious surface to block the bottom of the water reservoir compartment 112. The bottom surface 132 is generaly planar or flat to facilitate positioning of the sprinkler in an upright erect position.

The center of gravity 134 (FIGS. 8 and 9) of the sprinkler is positioned in proximity to the base 130 below the physical, volumetric, and geographical centers of the sprinkler. The low center of gravity 134 is positioned along the vertical axis of the sprinkler and facilitates pivoting and positioning of the sprinkler to an upright erect position.

In use, the coupling 120 of the fire hose 122 is connected to one of the arms 114 as shown in FIG. 1 after plugging the other arm 116 with the plug 126. The sprinkler 100 is then coiled in the hose 122 as shown in FIG. 2. The other end of the hose 122 can be attached to a fire hydrant 136 (FIG. 3) or other water source. The hose 122 is then flung and rolled towards the fire as shown in FIG. 3. The valve 138 (FIG. 4) on the hydrant is then opened with a wrench 140 or other tool to cause water to fill the hose 122. This will cause the hose to uncoil and unwind somewhat like a New Years Eve or birthday party favor (blower) to a position close to the fire without the need for anyone to get near the fire with the sprinkler. Once the hose unwinds, water will be injected out of the spray holes 106 of spray head 102 in a curved arcuate spray pattern and mist. The water pressure, spray, and special configuration of the sprinkler 100 cause the sprinkler to rotate and quickly stabilize in an upright erect position. The water spray helps quench the fire and set up a curtain and wall of water between the fire and firefighting personnel. The water spray also dissipates toxic gas and smoke emitted from the fire.

The sprinkler 200 of FIGS. 10–16 is structurally and functionally similar to the sprinkler 100 of FIGS. 1–9 except the fluid flow passageway 202 comprises an elongated, single, arcuate slot or slit 204. The slot 204 emits larger droplets than the rectangular holes 106 of the sprinkler 100 of FIGS. 1–9. Conversely, the rectangular holes 106 emit a finer mist and spray than the slot 204 of FIGS. 10–16.

The sprinkler 300 of FIGS. 17–26 is structurally and functionally similar to the sprinkler of FIG. 10–16 except the spray head 302, neck 304, and slot 306 are positioned at an angle of inclination ranging from about 45 degrees to about 75 degrees relative to the horizontal base 308. The head 302, neck 304, and slot 306 are positioned at an incline to spray the water at an angle of inclination of about 45 to about 75 degrees towards or away from the fire as desired. This permits the water to spray a further horizontal distance if desired.

The sprinkler 300 of FIGS. 17–26 also has three horizontal arms including a left side arm or port 308, a front arm or port 310, and a right side arm or port 312 to accommodate insertion of the hose in the left side, front, and right, sides of the sprinkler to alter the positioning of the spray head 302 and slot 306. The sprinkler 300 also has two similar plugs 314 and 316 which threadedly engage and plug the two arms of the sprinkler 300 which are not connected to the hose. The sprinkler 300 can have an arcuate set of apertures as in FIG. 1 instead of a slot.

The sprinklers 100, 200 and 300 of FIGS. 1–26 were tested at the Amoco Oil Company Refinery at Casper, Wyo. The tests achieved unexpected surprisingly good results. The hose quickly uncoiled and the sprinklers quickly and efficiently rotated and stablized in an upright erect position no matter which way the sprinkler landed after the hose uncoiled. The sprinkler was able to be remotely positioned near the test site of the fire while the firefighters remained safe at the hydrant and fire truck away from the fire. The sprinklers emitted a fine spray which is useful to quench oil fires and protect and cool firefighting personnel.

The dinosaur-back shaped sprinkler 400 of FIGS. 27–31 has a semicircular, arcuate rounded spray head and top 402 with an arcuate set of rectangular spray holes 404. The sprinkler 400 has flat semicircular side walls 405 and 406 and an internally inlet pipe 408 connected to the bottom of the side walls. The inlet pipe 408 has a closed end 410 and an open end 412 for attachment to a hose. A pair of transverse, curved, convex, stabilizing feet 414 and 416 are connected to the bottom of the inlet pipe 408 below the ends of the side walls to help stabilize the sprinkler 400.

The sprinkler 400 of FIGS. 27–31 was tested at the Amoco Oil Compandy Refinery at Casper, Wyo. and worked but was not as effective and dependable as the sprinklers 100, 200, and 300 of FIGS. 1–26.

Among the many advantages of the novel sprinklers and process of the subject invention are:

1. Safer for firefighting personnel.
2. Automatic and remote positioning of the sprinklers near fires.
3. Superb effectiveness.
4. Excellent efficiency.
5. Good dependability.
6. Better ability to quench petrolium fires.

Although embodiments of the invention have been shown and described, it is to be understood that various modifications and substitutions, as well as rearrangements of parts and process steps; can be made by those skilled in the art without departing from the novel spirit and scope of this invention.

What is claimed is:

1. A process for fighting fires in oil refineries, petrochemical plants, and the like, comprising the steps of:

attaching a hose to a sprinkler;

coiling the hose about the sprinkler;

attaching the other end of the hose to a water supply source;

rolling said coiled hose toward a fire while concurrently filling said hose with water from said water supply source to uncoil said hose and remotely move the sprinkler attached to the hose near a fire; and spraying a mist of water from said sprinkler onto the fire.

2. A process for fighting fires in oil refineries, petrochemical plants, and the like, comprising the steps of:

attaching a self-righting sprinkler to one end of a firefighting hose, said sprinkler having a rounded spray head, a water reservoir chamber, a physical center, a center of gravity below the physical center of said sprinkler, and a weighted base with a substantially planar bottom surface;

coiling said firefighting hose about said sprinkler;

attaching the other end of said firefighting hose to a water supply source selected from the group consisting of a fire hydrant, a fire engine, and a water tank;

rolling said coiled hose containing said sprinkler towards the fire; thereafter injecting a substantial quantity of water in said fire hose to substantially fill said fire hose;

remotely unwinding said fire hose and moving said sprinkler near the fire in response to filling said fire hose with said water;

remotely placing and maintaining said sprinkler in a substantially upright, erect position in the absence of firefighting personnel;

spraying an outwardly flared, converging pattern of water onto the fire from said sprinkler; and forming a curtain of water between said fire and firefighting personnel to enhance the safety and protection of the firefighting personnel.

3. A process in accordance with claim 2 wherein said water is sprayed at an angle of inclination towards the fire from a location in proximity to the ground.

4. A process in accordance with claim 2 wherein the water is sprayed substantially upwardly in a vertical spray pattern in a direction substantiallly perpendicular to said firefighting hose.

5. A process in accordance with claim 2 wherein the water is sprayed from said sprinkler in an upwardly direction substantially parallel to said firefighting hose.

6. A portable, self-erecting sprinkler for fighting fires in oil refineries, petrochemical plants, and the like, comprising:

a substantially hemispherical spray head having a rounded apex providing a top, said hemispherical spray head defining an arcuate fluid flow passageway extending from about 90 degrees to about 200 degrees through said top for spraying a mist of water onto the fire and concurrently emitting a curtain of water between the fire and firefighting personnel to enhance the safety and protection of firefighting personnel;

a rounded tubular neck extending substantially downwardly from said hemispherical spray head, said neck providing a water reservoir compartment and having tubular arms defining threaded ports communicating with said water reservoir compartment for connection to a fire hose, said tubular arms comprising a front arm and at least one side arm positioned substantially perpendicular at about right angles to said front arm;

a weighted base connected to and positioned below said rounded tubular neck, said base having a substantially rectangular imperforate bottom surface providing a solid water-impervious barrier for blocking the bottom of said water reservoir compartment, said bottom surface being substantially planar and extending outwardly of said tubular neck; and said sprinkler having a center of gravity in proximity to said base for facilitating pivoting of said sprinkler to a substantially upright, erect position when water is being sprayed from said spray head.

7. A portable, self-erecting sprinkler for fighting fires in oil refineries, petrochemical plants, and the like, comprising:

a substantially hemispherical spray head having a rounded apex providing a top, said hemispherical spray head defining an arcuate fluid flow passageway extending from about 90 degrees to about 200 degrees through said top for spraying a mist of water onto the fire and concurrently emitting a curtain of water between the fire and firefighting personnel to enhance the safety and protection of firefighting personnel;

a rounded tubular neck extending substantially downwardly from said hemispherical spray head, said neck providing a water reservoir compartment and having at least one threaded port for connection to a fire hose;

a weighted base connected to and positioned below said rounded tubular neck, said base having a substantially rectangular imperforate bottom surface providing a solid water-impervious barrier for blocking the bottom of said water reservoir compartment, said bottom surface being substantially planar and extending outwardly of said tubular neck;

said sprinkler having a center of gravity in proximity to said base for facilitating pivoting of said sprinkler to a substantially upright, erect position when water is being sprayed from said spray head;

said fluid flow passageway lying in a plane positioned from about 0 degrees to about 45 degrees relative to the vertical axis of said sprinkler;

said tubular neck having at least two arms extending laterally outwardly from said neck;

each of said arms defining an internally threaded port for connection to a fire hose;

said sprinkler including at least one externally-threaded plug for threadedly engaging and plugging the port of one of said arms; and said rounded spray head and tubular neck extending upwardly from said base at an angle of inclination. ranging from about 45 degrees to about 75 degrees.

* * * * *

UNITED STATES PATENT OFFICE
CERTIFICATE OF CORRECTION

Patent No. 4,836,291 Dated June 6, 1989

Inventor(s) David W. Owens and Jack E. Propp

It is certified that error appears in the above-identified patent and that said Letters Patent is hereby corrected as shown below:

| Patent Column | Line | |
|---|---|---|
| 1 | 52 | "effieiently" should read --efficiently-- |
| 2 | 3 | "important" should read --improved-- |
| 2 | 34 | "perferably" should read --preferably-- |
| 2 | 57 | "passgeways" should read --passageways-- |
| 3 | 25 | "-section" should read -- -sectional-- |
| 3 | 27 | "-section" should read -- -sectional-- |
| 4 | 15 | "extend" should read --extends-- |
| 4 | 25 | "horizonatally" should read --horizontally-- |
| 4 | 29 | "129." should read --126.-- |
| 4 | 35 | "hole" should read --holes-- |
| 5 | 41 | "right," should read --right-- |
| 6 | 15 | "petrolium" should read --petroleum-- |
| 6 | 19 | "steps;" should read --steps,-- |

Signed and Sealed this

Nineteenth Day of June, 1990

*Attest:*

HARRY F. MANBECK, JR.

*Attesting Officer* *Commissioner of Patents and Trademarks*